US006406108B1

(12) United States Patent
Upton et al.

(10) Patent No.: US 6,406,108 B1
(45) Date of Patent: Jun. 18, 2002

(54) DISPLAY CASE WITH DOOR-MOUNTED INTERNAL LIGHTING

(75) Inventors: Ronald D. Upton, Spartanburg; Harry A. Brancheau, Inman, both of SC (US)

(73) Assignee: Specialty Equipment Companies, Inc., Aurora, IL (US)

( * ) Notice: Subject to any disclaimer, the term of this patent is extended or adjusted under 35 U.S.C. 154(b) by 54 days.

(21) Appl. No.: 09/706,458

(22) Filed: Nov. 3, 2000

Related U.S. Application Data

(60) Provisional application No. 60/153,589, filed on Nov. 5, 1999.

(51) Int. Cl.[7] ..... A47F 3/04

(52) U.S. Cl. ..... 312/116; 312/138.1; 312/223.5; 362/125

(58) Field of Search ..... 312/116, 114, 312/138.1, 223.5, 405, 406; 362/92, 125; 52/656.4, 656.5, 656.6, 204.7, 204.62; 49/504

(56) References Cited

U.S. PATENT DOCUMENTS

| | | | | |
|---|---|---|---|---|
| 1,607,922 A | | 11/1926 | Schweitzer | |
| 2,163,562 A | | 6/1939 | Putnam et al. | |
| 2,336,416 A | * | 12/1943 | Parker | 362/125 |
| 2,438,972 A | | 4/1948 | Hoffman | |
| 2,816,318 A | | 12/1957 | Philipp | |
| 2,876,056 A | * | 3/1959 | Berger | 312/223.5 |
| 4,072,486 A | | 2/1978 | Joseph | |
| 5,072,343 A | * | 12/1991 | Buers | 312/223.5 X |
| 5,136,492 A | | 8/1992 | Rush | |
| 5,301,092 A | | 4/1994 | Santosousso et al. | |
| 5,363,611 A | * | 11/1994 | Richardson et al. | 312/116 |
| 5,374,116 A | * | 12/1994 | Borgen et al. | 312/116 |
| 5,471,372 A | | 11/1995 | Mamelson et al. | |
| 5,699,676 A | | 12/1997 | Trulaske, Sr. | |
| 5,879,070 A | | 3/1999 | Severloh | |
| 5,937,666 A | | 8/1999 | Trulaske, Sr. | |

FOREIGN PATENT DOCUMENTS

| | | |
|---|---|---|
| FR | 1022560 | 12/1952 |

* cited by examiner

*Primary Examiner*—Peter M. Cuomo
*Assistant Examiner*—Hanh V. Tran

(57) ABSTRACT

In a refrigerated display cabinet, the door frame includes a top rail, a bottom rail, and a pair of opposed side rails. At least one of the rails of the door frame is formed as a unitary structure that forms part of a channel that receives a central panel of the door, receives a lighting fixture and receives a gasket for sealing the door against a wall of the cabinet or against a mullion. A generally L-shaped retainer member engages the rail, the door's central panel and a lamp shield and is selectively removable to facilitate installation and/or replacement of the central panel of the door. The side rail can be configured with a utility compartment that is configured so as to be capable of housing a locking mechanism or a casting for a hinge mounting, depending on how the door is mounted to the cabinet. A handle can be mounted to the exterior surface of the side rail.

20 Claims, 8 Drawing Sheets

DISPLAY CASE WITH DOOR-MOUNTED INTERNAL LIGHTING

RELATED APPLICATIONS

The present application is a continuation-in-part application to provisional application Ser. No. 60/163,589, filed Nov. 5, 1999, which is hereby incorporated herein by this reference.

FIELD OF THE INVENTION

The present invention is generally directed to a display cabinet and particularly to a commercial display cabinet having an internal lighting system mounted in the door to the cabinet.

BACKGROUND OF THE INVENTION

While it has been suggested to mount flourescent light bulbs in the vertically extending, side frame members of the door of a commercial display cabinet, satisfactory implementation of such suggestions have been wanting. Impracticality of manufacture of frames containing the light fixture that includes an electrically powered lamp, is one problem. Replacement of the lamp by providing access suitable for the purpose is another problem. Handling of the frame during assembly to the cabinet as well as insertion of the central panel of glass or other material into the frame is a further problem. Various solutions employing an adjunct light fixture that was either interposed between one edge of the central panel and the side frame of the door or rested against the central panel adjacent the side frame member and attached thereto have been proposed as shown in U.S. Pat. Nos. 5,699,676 and 5,937,666 for example. However, these potential solutions are not problem free concerning assembly, replacement of the central glass panel of the door, and/or electrification of the lamp.

OBJECTS AND SUMMARY OF THE INVENTION

The present invention recognizes and addresses the foregoing problems, and others, of prior art constructions and methods. Accordingly, a primary object of the present invention is to provide a display cabinet having at least one lighting fixture built into the cabinet's door frame while reducing any impediment of the installation and assembly of the door's central panel.

In a presently preferred embodiment of the invention, the door frame includes a top rail, a bottom rail, and a pair of opposed side rails. At least one of the rails of the door frame is formed as a unitary structure that forms part of a channel that receives a central panel of the door, receives a lighting fixture and receives a gasket for sealing the door against a wall of the cabinet or against a mullion. Indeed, each of the rails can is be so configured or any combination of the rails can be so configured. A generally L-shaped retainer member engages the rail, the door's central panel and a lamp shield and is selectively removable to facilitate installation and/or replacement of the central panel of the door. The side rail can be configured with a utility compartment that is configured so as to be capable of housing a locking mechanism or a casting for a hinge mounting, depending on how the door is mounted to the cabinet. A handle can be mounted to the exterior surface of the side rail.

Additional objects and advantages of the invention will be set forth in part in the description which follows, and in part will be obvious from the description, or may be learned by practice of the invention. The objects. and advantages of the invention may be realized and attained by means of the instrumentalities and combinations particularly pointed out in the appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figure, in which.

These figures, which are incorporated in and constitute a part of this specification, illustrate exemplary embodiments of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
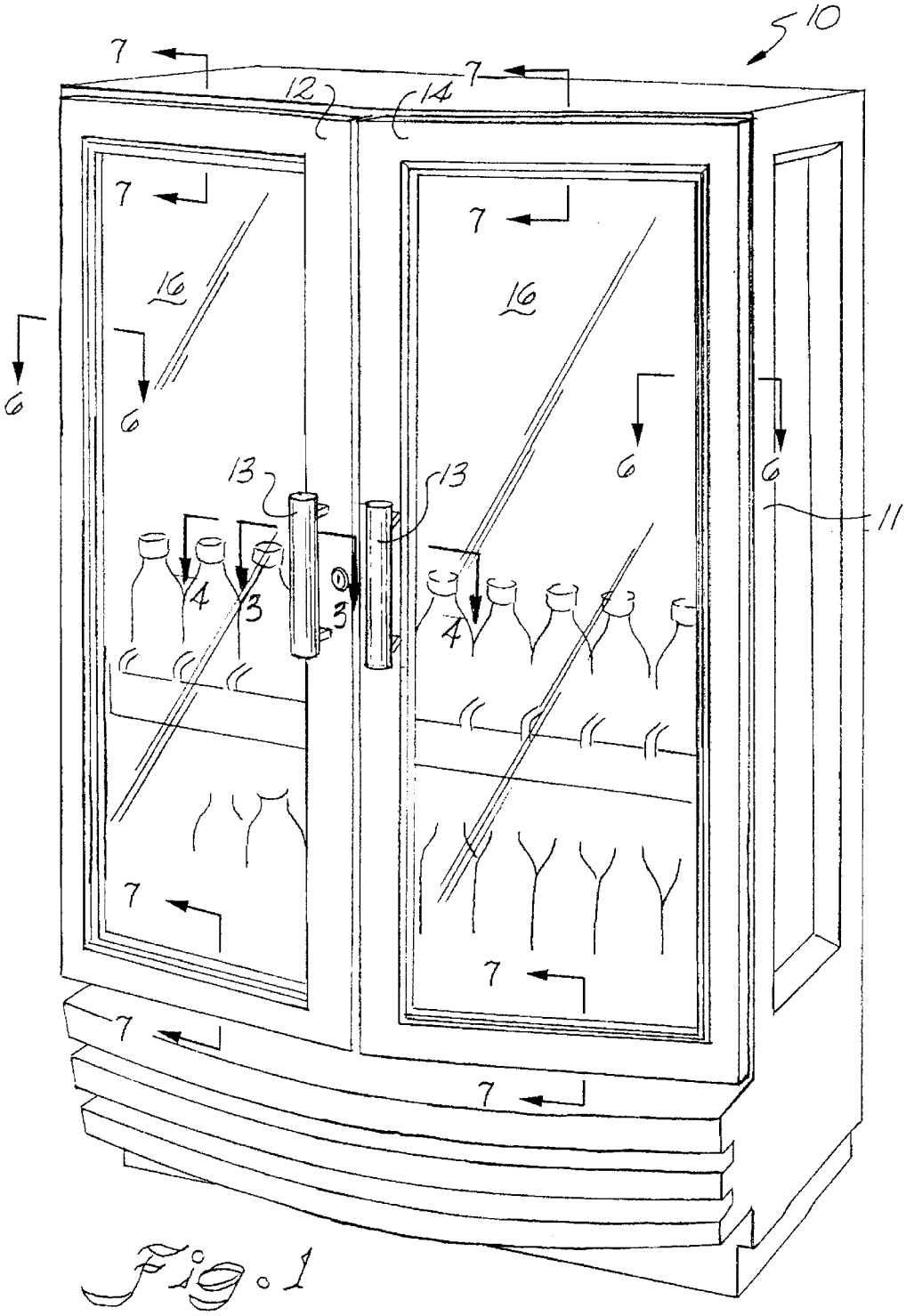
FIG. 1 is a front/side elevated perspective view of a display cabinet in accordance with the present invention.

In reference to FIG. 1, a refrigerated display case is generally designated by the numeral 10 and is provided with a cabinet 11 which defines an enclosure having an interior refrigerated space accessible via a front opening. Though not separately illustrated, the refrigeration equipment is conventional, as is the compartment of the cabinet that houses same.

As shown in FIG. 1, a pair of doors 12 and 14 is supported by the cabinet 11 and pivotally mounted thereon and may be selectively positioned to close the cabinet's front opening or allow access to the interior space of the cabinet's enclosure via the front opening. The rear of each door (which is designated 12 or 14 as shown in FIG. 1) is shown facing the viewer in FIGS. 2 and 5 and is the surface of the door that faces toward the interior space of the cabinet.

As illustrated in the figures, doors 12 and 14 are pivotally mounted near opposite sides of case 10 in a conventional manner for swinging movement between an open position and a closed position. If desired, the movable doors could be provided by one or more sliding glass doors. Though FIGS. 1–3 and 5 show an embodiment with the doors pivotally hinged near the side of the cabinet, one alternative embodiment could have both doors hinged at the center mullion 34 (FIG. 3) of the cabinet, and another alternative embodiment could have one door hinged at the center mullion of the cabinet and the other door hinged near the side of the cabinet. Moreover, the figures show a two-door embodiment, and a one door embodiment and a multi-door (more than two) embodiment are also contemplated. Handles 13 are used to permit the user to engage and pivot the doors 12 and 14.

Figure 2:
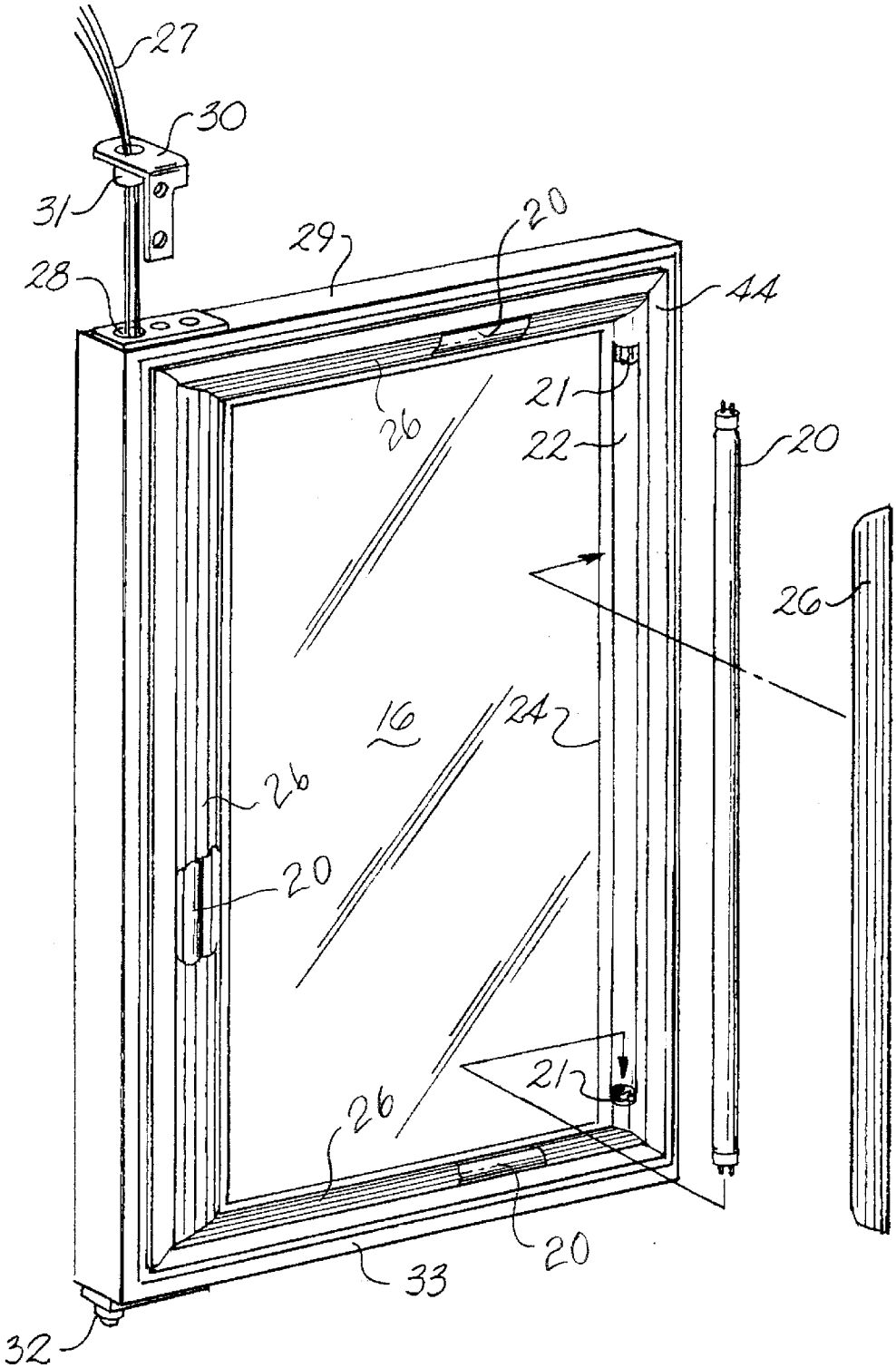
FIG. 2 is a perspective view of a door of a display cabinet in accordance with the present invention.

As shown in FIG. 1, each door 12, 14, includes a central panel 16 that is desirably transparent or translucent to permit viewing of the product within the enclosure, but also may be entirely opaque. Central panel 16 is carried in a door frame that surrounds the outer periphery of panel 16. As shown in FIG. 2, each door frame can include a pair of opposed side rails 24, 25, a top rail 29 and a bottom rail 33 that are joined together and frame the respective adjacent edges of the central panel 16. Central panel 16 can be configured to include a single pane 15 or multiple panes 15. The panes 15 may be formed of material that is opaque, translucent or transparent. As shown in FIGS. 3, 4 and 6–8, the central panel 16 can be heat insulating and formed of three panes or sheets 15 separated by spacers 18 that seal around the outermost peripheral portions of the panes and define spaces 19 therebetween. These spaces can be filled with air, argon, krypton or other insulating media.

As explained more fully below, an inner perimeter of each door 12, 14 defines part of a conventional seal and gasket arrangement to provide a substantially air tight thermal barrier for case 10 when the respective door is closed. As seen in reference to FIGS. 3 and 6–8 for example, a bellows portion 41 of a hollow door gasket 40 carries a magnet 42 which helps maintain the pivoting doors 12 and 14 sealed against the mullion 34 or forward edge of the cabinet 11 as the case may be. Door gasket 40 is desirably formed of flexible material such as polyvinylchloride that is elastically resilient and either single durometer or multi-durometer. If the latter, the stiffer material would compose the anchor portion 51, while the softer material would compose the resiliently deformable bellows portion 41 and be about 90 durometer Shore A for example.

Figure 4:
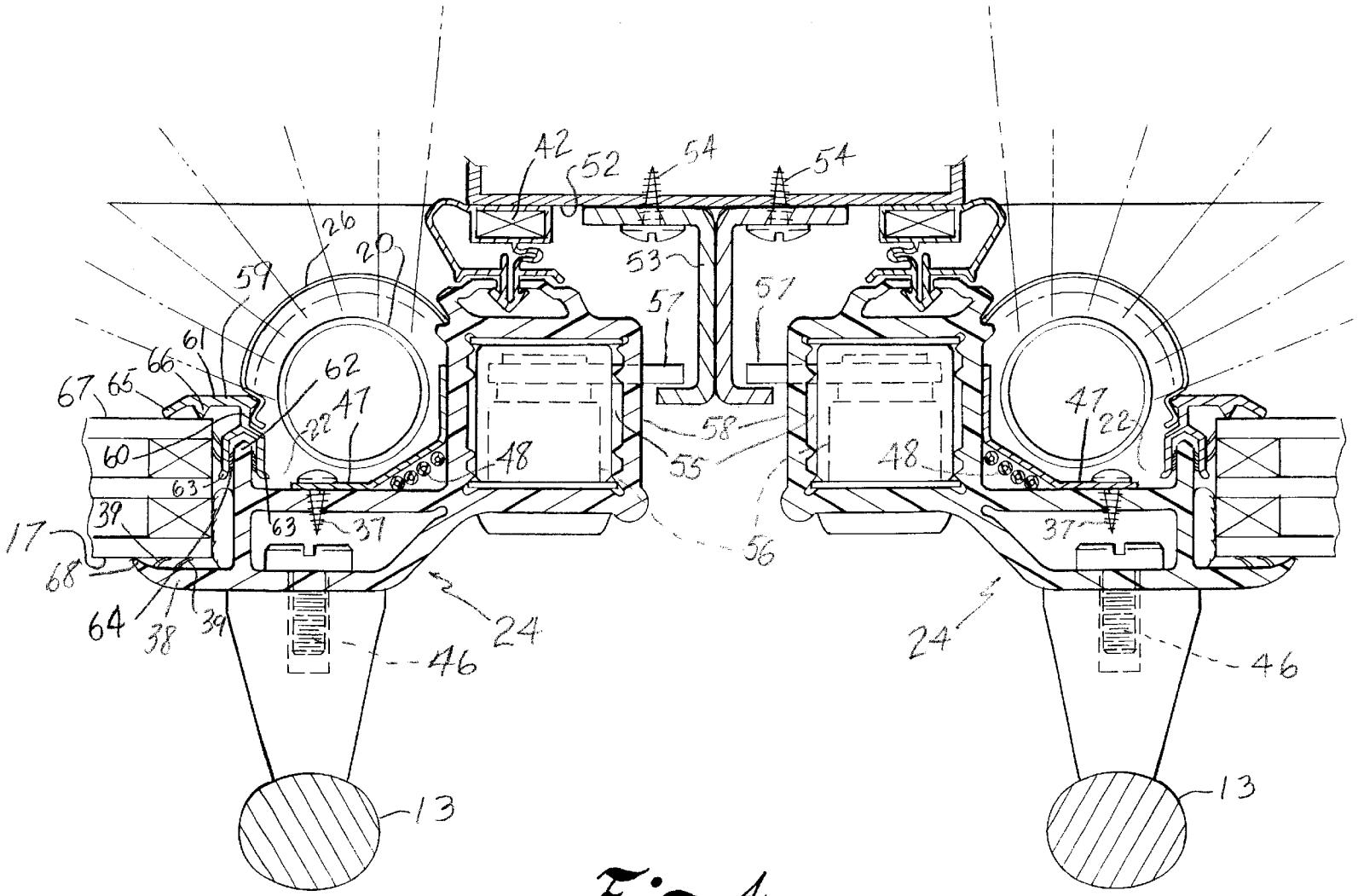
FIG. 4 is a sectional view taken along line 4—4 of FIG. 1.
Figure 5:
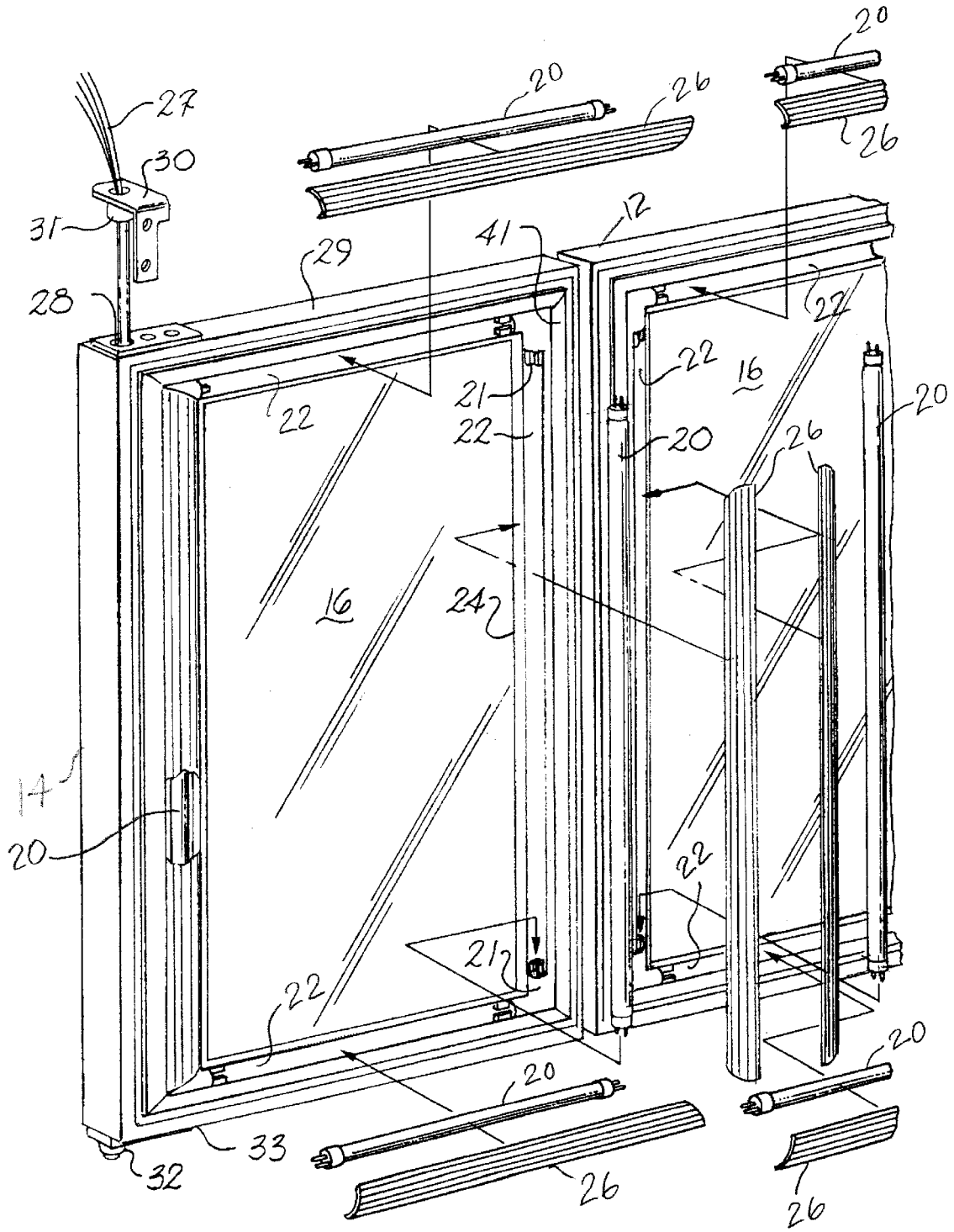
FIG. 5 is a perspective view of a pair of doors of a display cabinet in accordance with the present invention with only part of one of the doors shown.

As shown in FIGS. 2 and 5 for example, a lamp 20 is preferably provided in the form of a flourescent bulb that is elongated and is sized to measure a substantial portion of the length of the rail forming the door frame. Electrical receptacles 21 are disposed at the opposite ends of the light cavity 22 formed in a rearwardly facing portion of the rail of the frame of the door. Though each of the rails forming the frame are so configured in FIGS. 2 and 5, any combination of the rails can be so configured. For example, only one of the side rails 25 can be configured to receive a lamp 20, or only the top rail 29 and the rail that is hinged can be so configured, as desired. Any other combination of rails with or without lamps 20 can be employed according to the present invention. Similarly, one of the doors can have one lighting configuration of rails with or without lamps 20, and the other doors of the case can have a different lighting configuration. As shown in FIGS. 3, 4 and 6–8 for example, a mounting plate 47 of the light fixture can be attached to the walls of the light cavity 22 defined by the side rail member. Such attachment can be effected by mechanical fastening means such as screws 37 and/or rivets 48. Alternatively, such attachment can be effected by a fastenless engagement such as a friction engagement.

Figure 7:
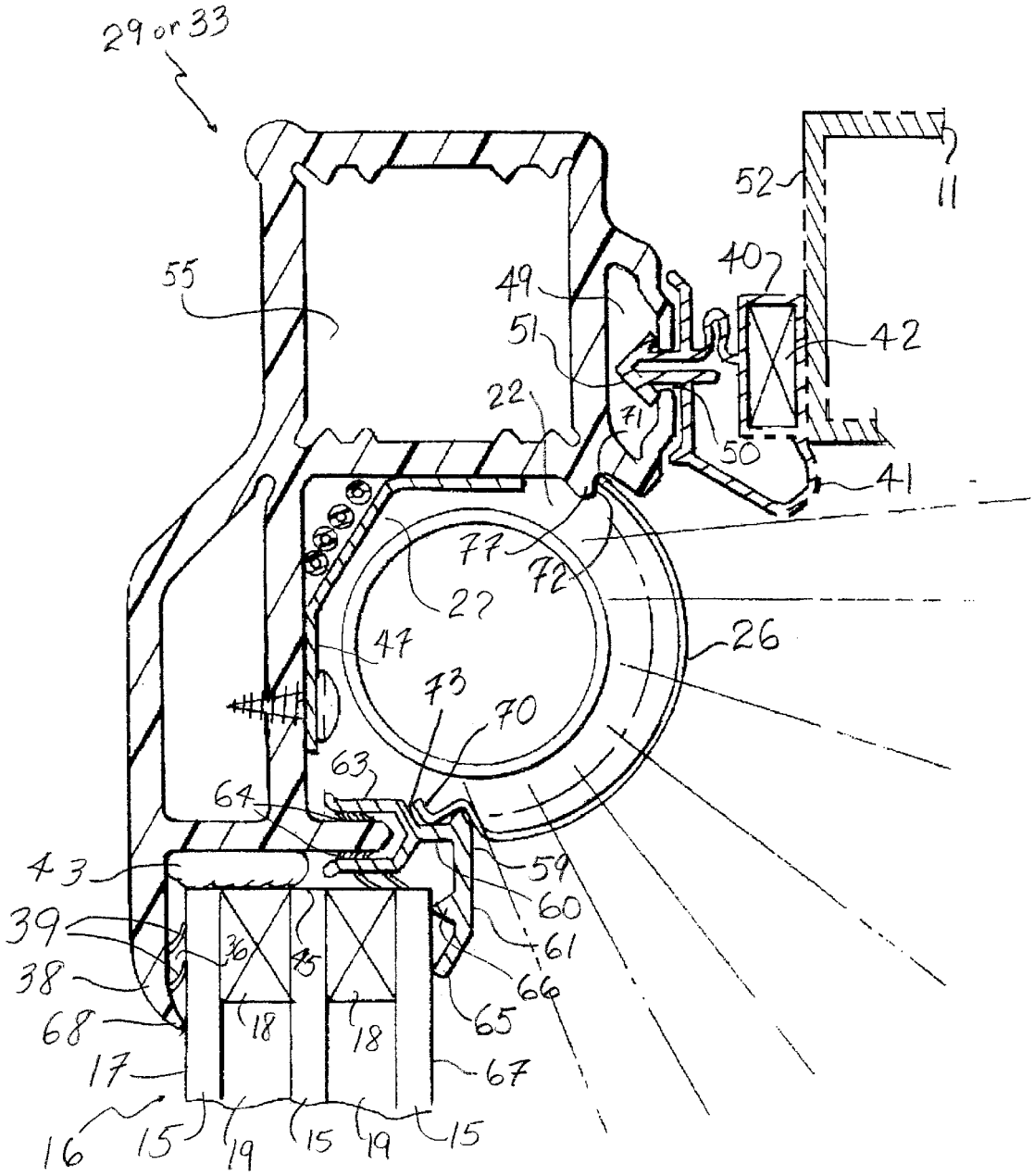
FIG. 7 is a sectional view taken along lines 7—7 of FIG. 1.
Figure 8:
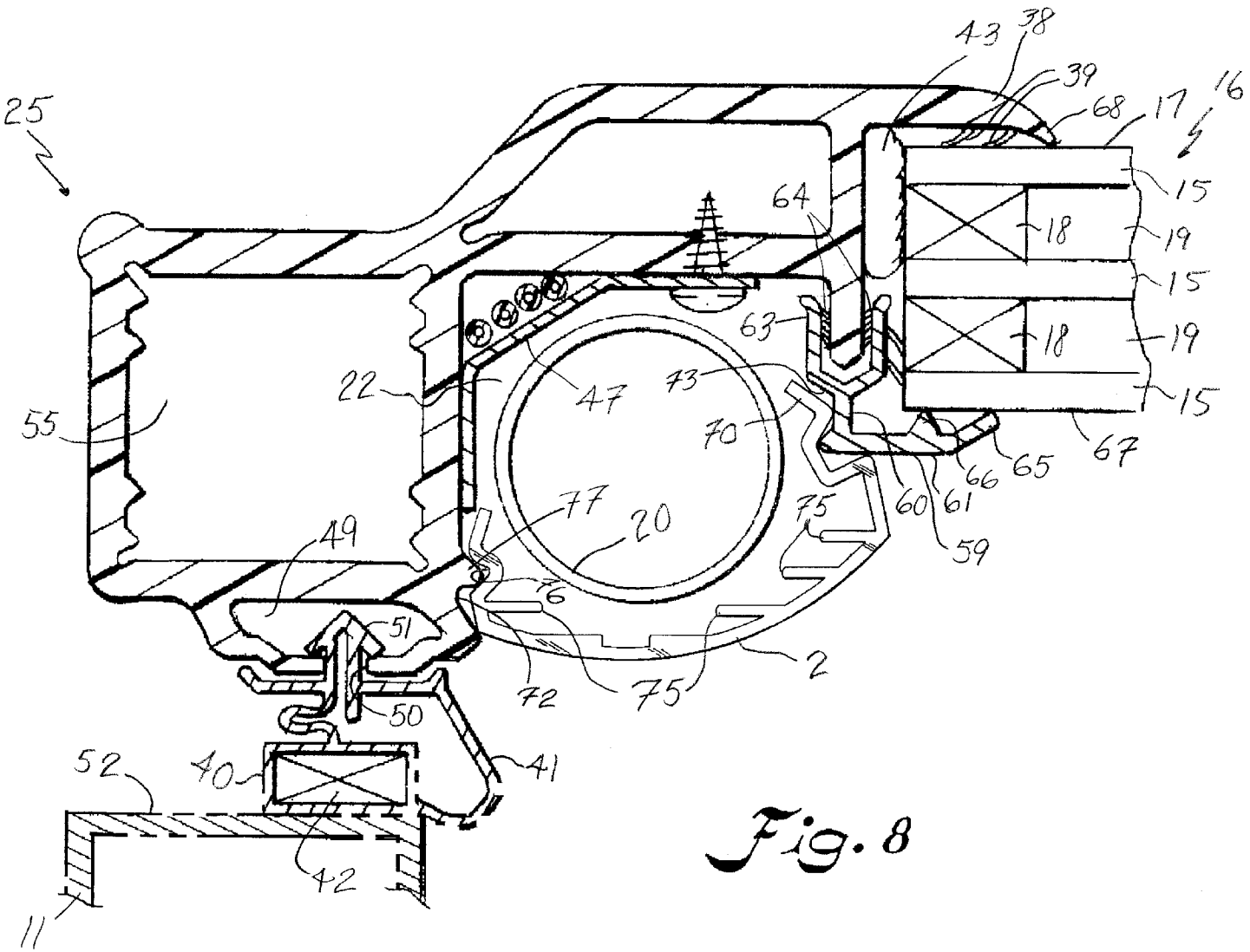
FIG. 8 is a sectional view similar to the view of FIGS. 6 and 7 but with an alternative embodiment of the lamp shield.

As shown in FIGS. 2–6 for example, a lamp shield 26 is fitted over the light cavity 22 to close off same and enclose the light bulb 20 within the cavity 22. Part of the lamp shield 26 covering the lamp 20 disposed along the hinged side rail 25 of the door frame is shown cut away in FIGS. 2 and 5 for example. As shown in FIGS. 2, 5 and 7 for example, similar lamp shields 20 can similarly be fitted over the light cavity of top rail 29 and/or bottom rail 33 of the frame of each door. An alternative configuration of the lamp shield is shown in FIG. 8 and designated 26*a*.

The lamp shield 26 or 26*a* is removable and can be attached to the door frame by any suitable means of mechanical fastening. For example, lamp shield 26 or 26*a* is desirably formed of a transparent or translucent material that is flexible and can be snapped into place for closure of cavity 22 and pried loose for removal and access to bulb 20 in cavity 22. Though not specifically illustrated herein, other means of removable attachment of the lamp shield to the frame of the door can include such conventional fastening means as screws, clips, hooks, detents and the like.

The lamp shield 26 can be provided in any number of colors and shapes. As shown in FIG. 7 for example, the lamp shield 26*a* can be configured as a lens that defuses or focuses the light emanating through the lens into the interior of the cabinet. This diffusion can be accomplished by providing on the interior surface of lamp shield 26*a* a plurality of directing ribs 75 that are configured to funnel a greater proportion of light across the front of the interior of the cabinet 11 when lamp shield 26*a* is disposed in the hinged side rail 25 as shown in FIG. 8. Similarly, this type of diffusing lamp shield 26*a* can be disposed in the handle side rail 24 to achieve the same function.

Figure 6:
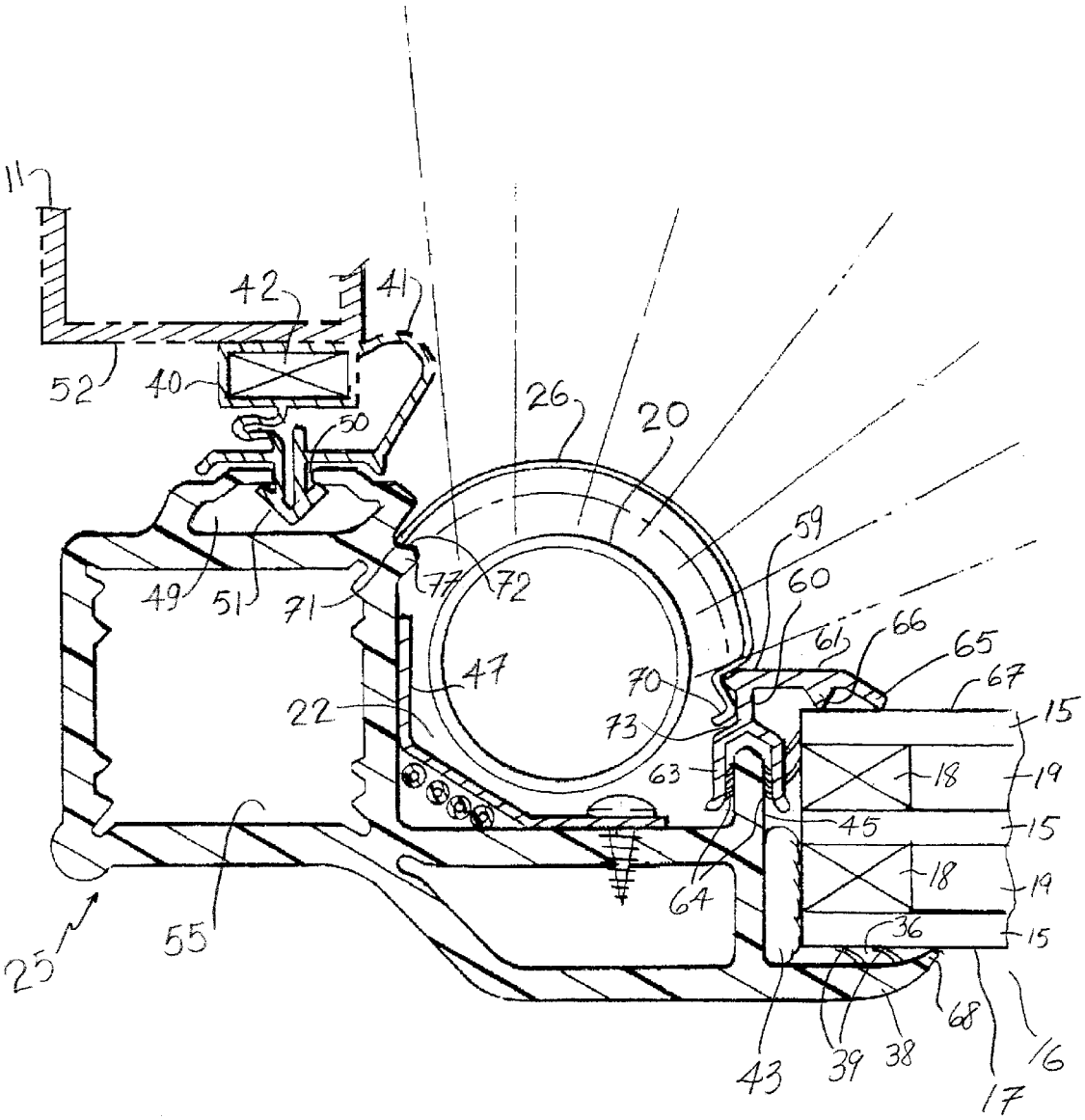
FIG. 6 is a sectional view taken along lines 6—6 of FIG. 1.

As shown in FIGS. 2 and 6 for example, the electrical wiring 27 to provide power to the electrical lamp 20 can be threaded through an opening 28 in the top rail member 29 of the door frame. A top hinge plate 30 is provided with a bushed sleeve 31 to protect the wiring 27 as shown. A spring cartridge 32 can be provided at the bottom rail 33 of the door frame to bias the door in the closed position. Alternatively, the wiring 27 can be provided through the bottom rail 33, and the spring cartridge 32 can be provided at the top rail 29 of the door frame. Moreover, the door frame could be configured so that wiring 27 passes through the frame at other points, which desirably would be located near the hinge pivot area so that strain on the wiring would be minimized.

Figure 3:
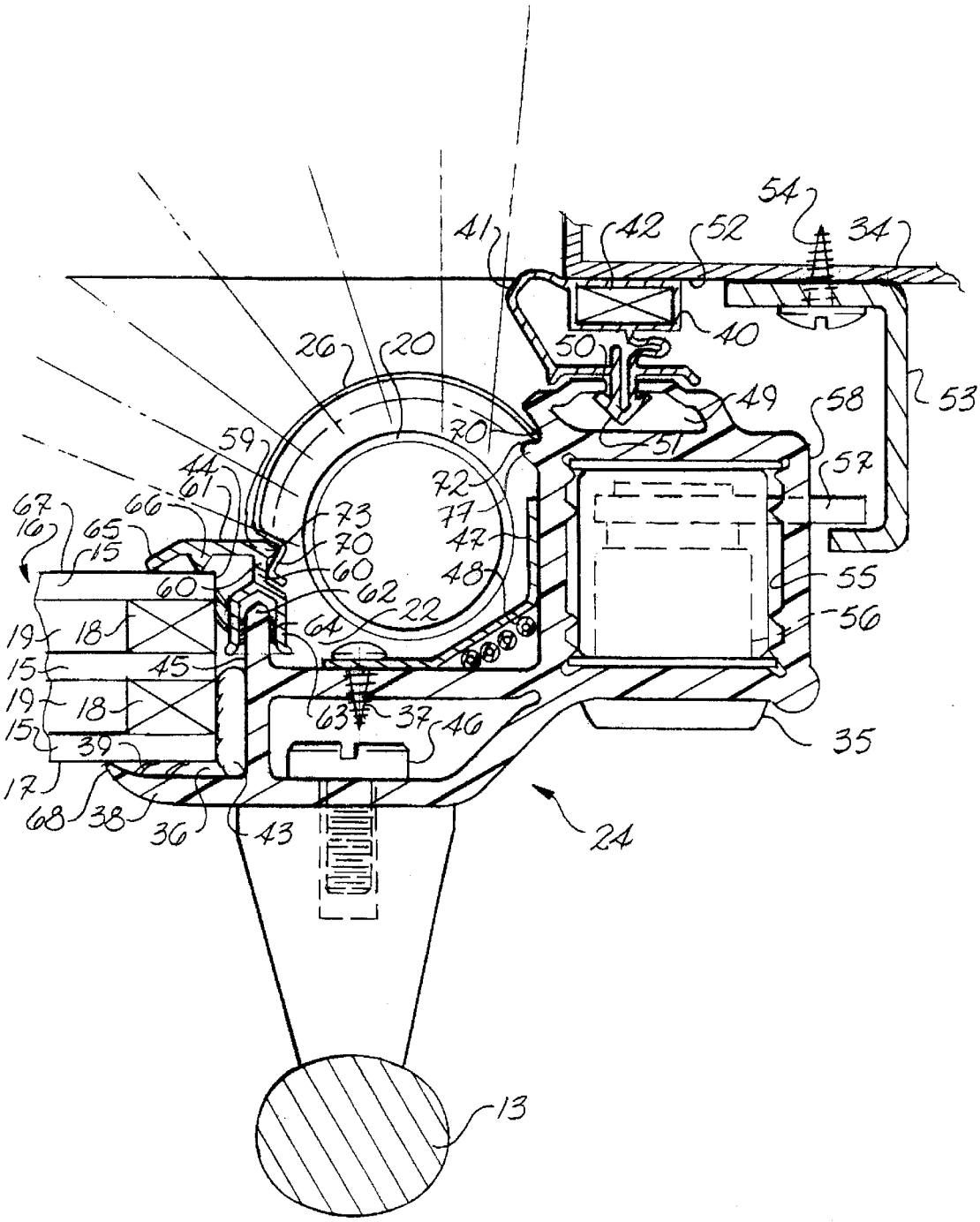
FIG. 3 is a sectional view taken along line 3—3 of FIG. 1.

As shown in FIG. 3, a cross-sectional view of a side rail of the door frame is generally designated by the numeral 24. As shown in FIG. 3, the handle side rail 24 can be provided in the form of a unitary structure that is configured to carry a locking mechanism 35, the door's handle 13, and a lighting fixture as well as forming part of a channel 36 that receives the edge of the door's central panel, which is generally designated by the numeral 16. As noted above, the hinged side rail 25 (FIGS. 2 and 6) alternatively can carry in the utility compartment 55 a casting for a hinge mounting instead of carrying the locking mechanism.

Side rails 24, 25, top rails 29 and bottom rails 33 desirably can be formed by an extrusion of plastic material such as polyvinylchloride or alternatively, molded sheets of such material in a thermal forming process. In the latter case, it might be necessary to form the each particular rail 24, 25, 29 or 33 as two separate components that are then joined together as by adhesives or other fastening means. Such other fastening means could include molecular fastening means such as sonic welding or twin sheet thermo-forming. Such other fastening means also could include mechanical fastening means like rivets, screws or bolts. Additionally, these rails of the frame of the door 11 also can be formed by injection molding and/or rotational molding.

As shown in FIGS. 3, 4 and 6–8, each rail of the door frame can include a receiving prong 38, which can be provided with one or more feelers 39 or bristles 39 that resiliently contact the exterior surface 17 of the door's central panel 16. A flexible cushioning shim member 43 also is provided between the edge surface 44 of the door panel 16 and the receiving base 45 of the channel 36 that is configured into each rail 24, 25 29 or 33 for receiving the perimeter portion of the door panel. This resilient shim member 43 can be provided continuously. along the entire length of the base 45 of the rail or can be interspersed at various intervals in discreet sections along the length of the rail. Typically, discrete accumulations of shim member 43 are provided at the corners of the door and thus are found near the ends of the side rails 24 or 25 and near the ends of the top rail 29 and bottom rail 33 of the door frame. The shim 43 can be provided as a bead of hot melt after insertion of the door panel 16 into the frame of a door 12, 14.

As shown in FIGS. 3 and 6 for example, the side rail 24 or 25 is provided with an anchor channel 49 that is accessible via an elongated slot 50 for receiving the anchor portion 51 of the door gasket 40 along the rearward facing surface of a portion of the side rail. The exposed bellows portion 41 of the door gasket 40 interacts with the outward facing surface 52 of the mullion 34 that opposes the rearward facing surface of the side rail 24. As shown in FIG. 3, the forward facing surface 52 of the mullion 34 (or cabinet wall) also can be provided with a lock strike 53 that can be attached to the mullion (or cabinet wall) by means of mechanical fasteners such as one or more screws 54. Similarly, as shown in FIG. 6, the exposed bellows portion 41 of the door gasket 40 interacts with the outward facing surface 52 of the edge of a wall of the cabinet 11 that opposes the rearward facing surface of the hinged side rail 25. In some embodiments, the rearward facing surface of the handle side rail 24 of the door 12, 14 will be opposing the edge of a wall of the cabinet 11 instead of a mullion 34.

As shown in FIGS. 3 and 4 for example, a handle 13 can be attached to the outer surface of the handle side rail 24 by mechanical fastening means such as screws 46. In some embodiments, it is desirable to have a lock for the door. Accordingly, the handle side rail 24 is also provided with a utility compartment 55 that is "lock-capable" by being configured to receive a rotatable locking cylinder (designated 56 in dashed line outline) of the locking mechanism 35. However, handle side rail 24 and hinged side rail 25 are formed by the same member and are defined depending on which side rail of the door frame they become during assembly. As noted above, utility compartment 55 is configured so that it also can house a casting for a hinge mounting such as spring cartridge 32 for example, if the door in question is oriented in a manner requiring the hinged side rail 25 to be on the hinged side of the door. This configuration of a dual purpose utility compartment 55 permits the same side rail member to be used on either the left or the right of the door's frame.

In the embodiment shown in FIGS. 3 and 4, the lock cylinder 56 can be provided with an internal cam 57 that can be pivoted as one rotates a key that the user has inserted into the cylinder via a keyhole (not visible in the view shown) that is accessed from the exterior of the side rail 24 of the door frame. The cam 57 extends through a slot (not shown in the view of FIGS. 3 and 4) defined in the outer side wall 58 of the utility compartment 55.

As shown in FIGS. 3, 4 and 6–8, a dual purpose retainer member 59 is provided in a generally L-shaped configuration having a main shaft 60 and a leg 61. The free end of the main shaft 60 of the retainer is bifurcated to form a casing that is configured to receive and connect with a projection flange 62 of the rail of the door frame. In the cross-section shown in FIGS. 3, 4 and 6–8 for example, the main shaft portion 60 of the L-shaped retainer 59 has a generally Y-shaped configuration with a free end portion that bifurcates into two opposed arms 63 that initially diverge from each other and then extend parallel to each other. The interior surface of each parallel section of each arm 63 of the bifurcated free end is provided with one or more deformable feelers 64 or bristles 64 that engage the projection flange 62 of the rail in a press fit connection therewith.

As shown in FIGS. 3, 4 and 6–8 for example, the leg 61 of the L-shaped retainer 59 extends in a direction that is generally perpendicular to the main shaft 60 of the L-shaped retainer and includes on one side surface thereof a free end in the form of a toe portion 65. A boss 66 is disposed between the toe portion 65 and the main shaft 60 of the L-shaped retainer 59. The toe portion 65 and the boss 66 engage one opposite exposed surface 67 of the door panel 16 and as shown in FIGS. 3, 4 and 6–8 for example, the surface 67 engaged by the toe portion 65 and boss 66 is the surface that faces toward the interior of the cabinet. The feelers 39 and forward lip 68 of the rail's receiving prong 38 face the opposite surface 17 of the central panel 16 of the door.

The construction of the present invention facilitates both changing the lamp 20 as well as changing the door panel 16. As shown in FIGS. 3 and 6–8 for example, a foot member 70 defined by a wrinkled end of lamp shield 26 or **26*a* rests in a recess 73 of retainer 59 that exists between a tail portion of leg 61 and main shaft 60. To change the lamp 20, the lamp shield 26 or 26*a* is removed from the recess 73 of L-shaped retainer 59 where recess 73 interfits with the lamp shield's foot member 70, which in cross-section has a Z-shape as shown in FIGS. 3 and 6 for example. The opposite edge 71 of the generally arcuate lamp shield 26 is received in a notch 72 formed along the length of a portion of the side rail 24 or 25. As shown in FIGS. 3 and 6–8 for example, this notch 72 is disposed near the portion of the rail member that receives the door gasket 40. Alternatively, as shown in FIG. 8 for example, the opposite end of the generally arcuate lamp shield 26*a* can include a groove 76 that runs along the length of the lamp shield 26*a* and is configured to receive therein a ridge 77 that runs along the length of the rail at the entrance of the light cavity 22**.

Changing the door panel 16 begins with removal of the lamp shield 26 or **26*a* as described above. Next, the L-shaped retainer 59 is pulled away from the projection flange 62 of the rail to release the central panel 16, which can be pulled away from the receiving channel 36 formed in the edge of the rail member. When the door panel 16 is replaced, the same L-shaped retainer 59 can be replaced on the projection flange 62 of the rail, or a new L-shaped retainer 59 can be provided, depending upon the condition of the L-shaped retainer upon its removal from the projection flange 63 of the rail. Thereafter, as shown in FIGS. 3, 6 and 7 for example, the unwrinkled free edge 71 of the lamp shield 26 can be inserted into the notch 72 formed in the rail member. Then the lamp shield 26 is slightly compressed so that the wrinkled end 70 of the lamp shield can be press fitted into the recess 73 formed on the portion of the L-shaped retainer where the main shaft 60 meets the leg 61. Alternatively, as shown in FIG. 8 for example, the wrinkled end 70 of the lamp shield 26***a* can be inserted into the recess 73 formed on the portion of the L-shaped retainer where the main shaft 60 meets the leg 61. Then the lamp shield 26*a* is slightly compressed so that the ridge 77 of the rail is received into the groove 76 of the lamp shield 26*a*, and the tension in the slightly compressed lamp shield 26*a* holds the lamp shield snugly in place without any freedom to produce vibrations that might otherwise produce unwanted noise during operation of the case 10.

While a preferred embodiment of the invention has been described using specific terms, such description is for illustrative purposes only, and it is to be understood that changes and variations may be made without departing from the spirit or scope of the foregoing description. In some embodiments for example, only one side rail needs to be configured with the light cavity, and that side rail can be either the hinged side rail or the handle side rail.

What is claimed is:

1. A display case, comprising:

a cabinet defining an enclosure, said enclosure defining a front opening and an interior space accessible via said front opening;

at least one door mounted to said cabinet and configured so as to be selectively positioned to cover said front opening of said enclosure in at least a first orientation of said door and to allow access to said interior space of said cabinet's enclosure via said front opening in at least a second orientation of said door;

said at least one door includes a central panel having an outer periphery including at least one edge, said door includes a door frame that surrounds said outer periphery of said central panel, said door frame includes a top rail, a bottom rail disposed opposite said top rail, and at least one side rail that is disposed between said top rail and said bottom rail;

at least one of said rails defining a channel configured for receiving said edge of said central panel, said one rail defining a utility compartment disposed opposite said channel and configured for receiving therein at least one of a locking mechanism and a hinge mechanism, said one rail defining a light cavity disposed between said channel and said utility compartment and defining an opening to the interior of said light cavity, said one rail defining a projection flange that defines one side of said opening of said light cavity;

a light fixture disposed in said light cavity; and a retainer member removably secured to said projection flange of said one rail and configured and disposed to retain said edge of said central panel in said channel of said one rail.

2. A display case as in claim 1, further comprising a lamp shield removably connected to said one rail to cover said light cavity.

3. A display case as in claim 2, wherein said lamp shield defining a first side edge and a second side edge opposed to said first side edge, said retainer member defining a recess therein; and said first side edge of said lamp shield defining a foot member disposed in engagement with said recess of said retainer member.

4. A display case as in claim 2, wherein said lamp shield defining a first side edge and a second side edge opposed to said first side edge, said side rail defining a notch disposed on the opposite side of said light cavity from said projection flange; and said second side edge of said lamp shield being disposed in engagement with said notch of said side rail.

5. A display case as in claim 2, wherein said lamp shield defining an interior surface and a plurality of directing ribs extending from said interior surface of said lamp shield and configured and disposed to funnel light from said lamp across the front of said interior of said cabinet.

6. A display case as in claim 1, wherein said one rail defines a front, and the display case further includes a handle connected to said front of said one rail.

7. A display case as in claim 6, wherein said one rail defines a rear disposed opposite said front, and the display case further includes a door gasket connected to said rear of said one rail.

8. A display case as in claim 7, wherein said door gasket includes a magnetic element.

9. A display case as in claim 8, wherein said door gasket is formed at least in part of resiliently deformable material.

10. A display case as in claim 1, wherein said one rail defines a rear, and the display case further includes a door gasket connected to said rear of said one rail.

11. A display case as in claim 10, wherein said door gasket includes a magnetic element.

12. A display case as in claim 10, wherein said door gasket is formed at least in part of resiliently deformable material.

13. A display case, comprising:

a cabinet defining an enclosure, said enclosure defining a front opening and an interior space accessible via said front opening;

at least one door mounted to said cabinet and configured so as to be selectively positioned to cover at least half of said front opening of said enclosure in at least a first orientation of said door and to allow access to said interior space of said cabinet's enclosure via said front opening in at least a second orientation of said door;

said at least one door includes a central panel having an outer periphery including at least one edge, said door includes a door frame that surrounds said outer periphery of said central panel, said door frame includes a top rail, a bottom rail disposed opposite said top rail, and two side rails that are disposed between said top rail and said bottom rail;

at least one of said top and bottom rails defining a front and a rear disposed opposite said front, said one rail defining a channel configured for receiving said edge of said central panel, said one rail defining a utility compartment disposed opposite said channel and configured for receiving therein at least one of a locking mechanism and a hinge mechanism, said one rail defining a light cavity disposed between said channel and said utility compartment and defining an opening to the interior of said light cavity, said one rail defining a projection flange that defines one side of said opening of said light cavity, said one rail defining a notch disposed on the opposite side of said light cavity from said projection flange;

a light fixture disposed in said light cavity;

a retainer member removably secured to said projection flange of said one rail and configured and disposed to retain said edge of said central panel in said channel of said one rail, said retainer member defining a recess therein; and a lamp shield configured to cover said light cavity and defining a first side edge and a second side edge opposed to said first side edge, said first side edge of said lamp shield defining a foot member disposed in engagement with said recess of said retainer member, said second side edge of said lamp shield being disposed in engagement with said notch of said one rail.

14. A display case as in claim 13, wherein at least one of said side rails defines a front, and the display case further includes a handle connected to said front of said at least one side rail.

15. A display case as in claim 13, wherein said one rail defines a rear disposed opposite said front, and the display case further includes a door gasket connected to said rear of said side rail.

16. A display case as in claim 15, wherein said door gasket includes a magnetic element.

17. A display case as in claim 16, wherein said door gasket is formed at least in part of resiliently deformable material.

18. A display case as in claim 13, wherein said one rail defines a rear, and the display case further includes a door gasket connected to said rear of said one rail.

19. A display case as in claim 18, wherein said door gasket includes a magnetic element.

20. A display case as in claim 18, wherein said door gasket is formed at least in part of resiliently deformable material.

* * * * *